United States Patent [19]

Schaapveld

[11] Patent Number: 4,467,945

[45] Date of Patent: Aug. 28, 1984

[54] BABY CARRIER

[76] Inventor: Junice A. Schaapveld, 8414 - 14th Ave. South, Bloomington, Minn. 55420

[21] Appl. No.: 564,841

[22] Filed: Dec. 23, 1983

[51] Int. Cl.[3] ..... A47D 13/02

[52] U.S. Cl. ..... 224/160; 297/467

[58] Field of Search ..... 224/160, 215; 297/467, 297/483

[56] References Cited

U.S. PATENT DOCUMENTS

| | | | |
|---|---|---|---|
| 278,437 | 5/1883 | Lancaster . | |
| 2,535,683 | 12/1950 | Kimball . | |
| 3,197,100 | 7/1965 | Thompson | 224/160 |
| 3,481,517 | 12/1969 | Aukerman | 224/160 |
| 3,780,919 | 12/1973 | Hansson . | |
| 3,871,562 | 3/1975 | Grenier . | |
| 4,009,808 | 3/1977 | Sharp | 224/160 |
| 4,037,764 | 7/1977 | Almosnino et al. . | |
| 4,234,229 | 11/1980 | Arnold . | |
| 4,402,440 | 9/1983 | Purtzer et al. | 224/259 X |
| 4,428,514 | 1/1984 | Elf | 224/160 X |

FOREIGN PATENT DOCUMENTS

| | | | |
|---|---|---|---|
| 2028633 | 3/1980 | United Kingdom | 224/160 |

OTHER PUBLICATIONS

Page From a Recent Sears Catalog Showing a "Comfort Carrier" and a Cradle Carrier.

Folder Entitled "Snugli 2 Soft Baby Carrier Parents Handbook".

*Primary Examiner*—Steven M. Pollard

*Attorney, Agent, or Firm*—Robert C. Baker

[57] ABSTRACT

A baby carrier comprising a harness for attachment to an adult independently of and preliminary to placing a baby in the carrier, plus a baby support panel fixed to the harness. The harness includes a waistband for fastening about the torso of an adult at or above the waist, and two shoulder straps fixed to the waistband at spaced locations for extending up from the waistband along lateral portions of the upper frontal torso of the adult and over the shoulders and then in crossed relationship on the back upper torso of the adult. The ends of the shoulder straps are removably fastened to the waistband at lateral locations on the waistband as worn by an adult. The baby support panel is fixed to the waistband of the harness of the adult. It has leg openings proximate to the waistband and includes means at the lateral edges of the end of the panel most remote from the waistband for removable fastening to anchor elements on the shoulder straps of the adult at a location proximate to the portion of the shoulder straps passing over the shoulders of the adult.

14 Claims, 4 Drawing Figures

BABY CARRIER

BACKGROUND OF THE INVENTION

This invention relates to a baby carrier of the flexible type having means for attachment to the upper torso of an adult and means for carrying the baby.

Flexible baby carriers as heretofore known have comprised a multitude of special strapping or components, frequently with the baby first lodged and strapped into the carrier and then the carried attached to the adult. The problem with this approach is not only that it requires joggling of the baby while fitting the carrier to the adult, but also generally requires dismantling of the carrier apparatus from the adult before removing the baby for special care as frequently required. Other known flexible carriers have confusing harnesses for attachment to the adult, or straps which extend between the adult and the baby and tend to create discomfort, or a baby carrier portion of a design making it difficult to remove and insert the baby, or harness elements or straps which press against the baby and tend to create discomfort.

SUMMARY OF THE INVENTION

My new baby carrier has no straps or body elements which extend between the baby and an adult except for the waistband which extends about the adult. It has no strap about the neck of an adult and therefore avoids causing an adult to suffer neck strain. It permits harnessing of the adult completely separately from any required handling of the baby, with the baby placed in the carrier and easily removable from it without alteration of the harness about the adult. It contains no uncomfortable straps that press against the baby's body. Only two fasteners are employed for holding the baby in the carrier after the carrier has been attached to an adult. The design is such that only one fastening means need be unfastened for removal of the baby from the carrier. Importantly, the harnessing of the adult is accomplished in a manner providing for comfortable weight distribution of the baby as borne by the adult.

This new baby carrier comprises a base harness for attachment to the upper torso of an adult independently of and preliminary to placing a baby in the carrier. The harness has a waistband for fastening about the upper torso of an adult at or above the waist, preferably at a location at the base of the rib cage so that the weight of the baby is supported in part or even substantially by the adult rib cage. The base harness for the adult includes two shoulder straps fixed to the waistband at spaced locations. These shoulder straps extend substantially directly up from the waistband along lateral portions of the upper frontal torso of the adult. The shoulder straps extend over the shoulders and then in crossed relationship at the back of the upper torso of the adult. The ends of the shoulder straps are removably fastened to the waistband at lateral locations on the waistband as it is worn by the adult.

The baby panel of this carrier is characterized by the fact that it is fixed solely to the waistband of the harness of the adult. It has leg openings proximate to the waistband. In this respect, the panel preferably is formed with U-shaped leg openings, with the material across the open end of the U being that of the waistband of the harness for the adult. The baby support panel further includes means at the lateral edges of the end of the panel most remote from the waistband for removably fastening the panel to anchor elements on the shoulder straps of the adult harness at a location proximate to the portion of those shoulder straps passing over the shoulder of the adult.

Especially significant is the fact that my new baby carrier distributes the weight of the baby as carried by the adult in a manner such that the shoulders of the adult carry a substantial portion of the weight of the baby, and a portion of the baby's weight is also carried at the waistband location on the adult. Padding is employed to enhance comfort for both the adult and the baby.

Other features and benefits of the invention will be evident as this description proceeds.

DESCRIPTION OF PREFERRED EMBODIMENT

Figure 1:
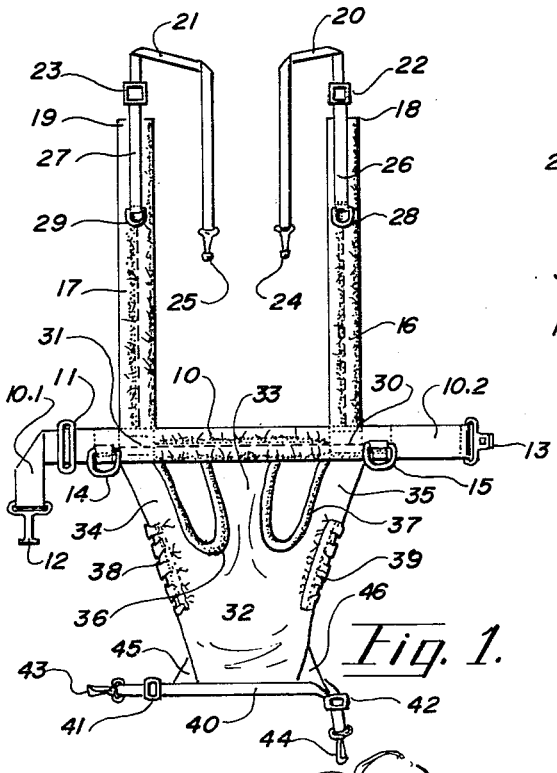
FIG. 1 is a frontal plan view of the entire baby carrier including the adult harness portion.

The elements making up the baby carrier of this invention are given the same numbering in all Figures of the drawing. For the sake of simplicity, however, the finite details of the structure of the baby carrier will be discussed with particular reference to FIG. 1.

The waistband 10 is adjustable in length suitably by means of an adjusting buckle 11. The portion 10.1 of the waistband extends through a loop carrying the male fastening element 12 and then extends back and is fixed to the adjusting buckle, as is conventional for adjusting buckles for waistbands. The male fastening element 12 is adapted for removable fastening to the female fastening element 13 of the waistband. Suitably, the fastening element 13 is fixed in location on the waistband since there is no need to have more than one means for adjusting its length. Also the precise position of fastening may be located at any point along the back portion of an adult wearing the harness. Fixed on the waistband are two anchors 14 and 15 in a spaced relationship laterally out from the point at which shoulder straps 16 and 17 are fixed to the waistband. Anchors 14 and 15 occupy a position at the lateral sides of the upper torso of an adult wearing the harness. These anchoring elements are for removably fastening the ends of shoulder straps during the harnessing of the adult. A greatly preferred feature of the waistband 10, at least in the portion thereof between the dotted vertical line immediately to the left of anchor 14 and the dotted vertical line immediately to the right of anchor 15 is that of padding. Preferably, that section of the waistband is formed of a double layer of cloth with a foam padding between the layers and a stitch line down the center of the waistband. Padding for the waist band is at least employed for the portion of it between the fixed locations 30 and 31 for the shoulder straps.

Shoulder straps 16 and 17 are fixed at the laterally spaced locations 30 and 31 of the waistband 10. Observe that the fixing points for the shoulder straps 16 and 17 are such that those points 30 and 31 are adjacent or proximate the anchors 14 and 15 and also lie at a lateral body location as the harness is worn by an adult. Further, shoulder straps 16 and 17, preferably padded through their length up to the points 18 and 19 of FIG. 1, are such that they extend upward from the waistband and are located at lateral sides of the frontal upper torso of an individual wearing the harness. The padded length of the shoulder straps should be at least long enough to extend over the top of the shoulder of the wearer. The continuation of the shoulder straps may be narrower, as indicated at the portion of the shoulder straps labeled 20 and 21, with each shoulder strap provided with buckle means 22 and 23 for adjustability of length in a manner comparable to the structure provided for adjustability of the length of the waistband 10. Each shoulder strap is provided at its terminal end with a snap or clip fastener 24 and 25. Importantly, an overlap of the narrower width 26 and 27 of the shoulder straps onto the wider padded length of the shoulder straps is fixed as by sewing.

Anchors 28 and 29 in the nature of O-rings or D-rings are permanently fixed to the shoulder straps at a location which places them proximate to the shoulder of an adult wearing the harness, preferably at a slightly frontal position on the shoulder of the adult. Illustratively, anchors 28 and 29 may be permanently fixed in a sewed overlap of the narrower width shoulder strap portions 26 and 27, i.e., in an overlap of that portion which is sewed along its length onto the wider width of the shoulder strap as shown in the drawing.

Figure 2:
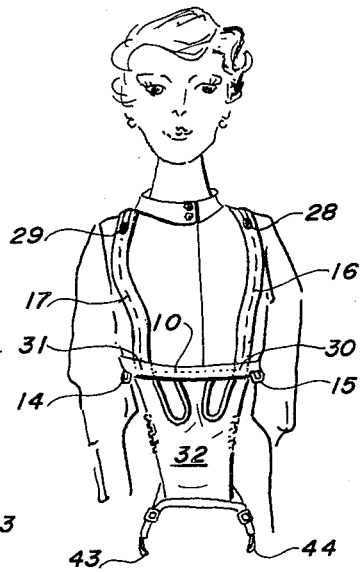
FIG. 2 is a frontal plan view of the baby carrier with the adult harness portion in position on an adult.
Figure 3:
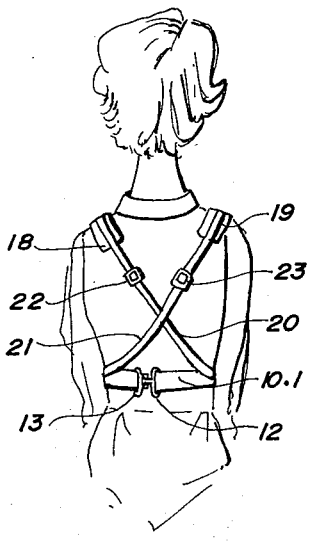
FIG. 3 is a back view of the upper torso of an adult, and shows the crossing of the shoulder straps at the back of the adult and then their attachment in removable fashion to the waistband at lateral locations on the waistband.

From FIGS. 2 and 3, it will be evident that shoulder straps 16 and 17 extend up lateral sides of the frontal torso of the wearer, with the extremity of the padded portion 18 and 19 passing over the shoulders of the wearer. Then the shoulder straps extend down the back of the wearer and are fastened by their fastening clips 24 and 25 to the waistband shoulder strap anchors 14 and 15. In effect, the shoulder strap 16 passes up the left frontal portion of the wearer and over the left shoulder of the wearer, and then ends up with its narrower width 20 crossing to the right on the back of the wearer and finally fastened by clipping it to waistband anchor 14, which is proximate to the location 31 at which the right shoulder strap 17 is fixed to the waistband 10. Similarly, the other or right shoulder strap 17 at the frontal upper torso of a wearer ends up clipped to the waistband anchor 15 at the left side of the wearer.

To be stressed is the fact that the harness for the wearer is so designed that the wearer has only three clips or fasteners to attach; and each of the clips or fasteners is attachable at a location on the adult making it very convenient for the wearer to handle all the operations of attaching the harness in position. Specifically, after the lengths for the waistband and for the shoulder straps are properly adjusted for an individual by shifting the position of the adjustment buckles 11, 22, and 23, all the wearer has to do is attach the waistband by means of its fasteners 12 and 13 and then draw the shoulder straps directly upward over the shoulders and cross them at the back and clip them at side locations to anchors 14 and 15. Preferably, the length of the shoulder straps is so adjusted as to place the waistband 10 at a location slightly above the waist and at the base of the rib cage, for weight support reasons. Anchors 28 and 29 on the shoulder straps at the shoulder level, whether on top of the shoulders or slightly forward therefrom, are conveniently available for fastening the baby support panel 32; and the features of that panel will now be discussed.

The baby support panel 32 functions more or less as a covering for the baby, but a covering which effectively permits the baby to be next to the body of an adult without any strapping or covering between the baby and the adult except for the waistband 10. A central crotch section 33 of the panel 32 is fixed as by sewing to waistband 10 at a medial or central location along the lower edge of the waistband 10 and between the locations 30 and 31 at which the shoulder straps are fixed to the waistband. Further, lateral sections 34 and 35 of the panel 32 also are fixed as by sewing to the lower edge of waistband 10; and these lateral sections 34 an 35 are joined to the waistband 10 at positions approximately directly in line with the lateral locations 30 and 31 from which the shoulder straps 16 and 17 extend upwardly. This is a preferred feature inasmuch as the weight of the baby, as carried by the sections 34 and 35 of the baby support panel, is well supported at the waistband through the shoulder straps 16 and 17 so as to minimize sagging of the waistband.

Between crotch section 33 and each lateral section 34 and 35 are leg openings with padded rib edges 36 and 37 which form the border for the leg openings. Observe that in the preferred structure the leg openings are formed by an essentially U-shaped edge of the panel 32, with a straight lower edge of the waistband 10 completing the openings for the legs of a baby. Thus, the leg openings literally have a border formed by the waistband 10. At the very least, however, the leg openings must be proximate to the waistband for maximum realization of the weight distribution benefits for carrying a baby according to the invention. The arrangement is such that the adult lower rib cage can be employed to bear most or all of the baby's weight, with but a relatively smaller part bearing on the shoulders.

Figure 4:
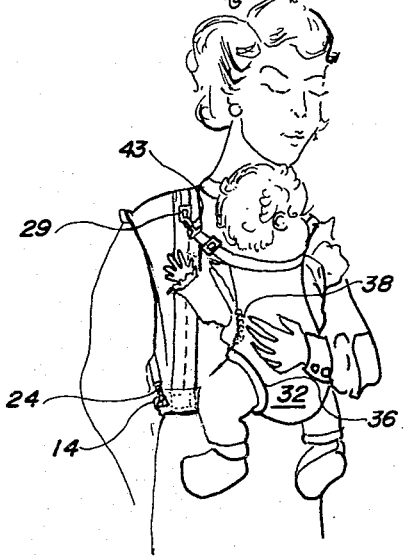
FIG. 4 is a schematic perspective view of the baby carrier on an adult, and shows the baby support panel of the carrier about a baby and fastened at the shoulder level of the adult.

A further feature of the preferred baby support panel is that of gathered elasticized edges 38 and 39. Suitably, the entire baby support panel is formed of a double layer of cloth. Sections 38 and 39 of limited length along the lateral edges have embedded and sewn therein an elastic strip which causes a gathering effect at those sections. The elasticized sections 38 and 39 extend along the edges of the panel for a distance just sufficient to contribute to conformance of the panel about the buttocks and up the side of a baby placed in the carrier. Illustratively, the limited length 38 of the edge which is elasticized extends from a point located laterally outward from the border 36 of a leg opening through a distance sufficient to cause the panel 32 to be gathered at its sides and upwardly from the buttocks of a baby (see FIG. 4).

The end of the baby support panel most remote from waistband 10 is preferably provided with a reinforcing strip of cloth 40 extending more or less in a horizontal direction across that end; and this reinforcing strip 40 continues laterally outward from the support panel 32 to form straps which are adjustable in length by means of adjustment buckles 41 and 42, with the ends of the straps having fasteners in the nature of clip or snap fasteners 43 and 44. A triangular reinforcing web of material 45 and 46 may be employed to improve the strength of connection between the panel 32 and the terminal strip or strap 40.

In use, after the adult has been harnessed, the baby is picked up and its legs placed through the leg openings having borders of padding 66 and 37. Then the adult simply pulls the panel 32 up the back of the baby, holds the panel 32 against the back of the baby with one hand while using the other hand to snap one of the clips 43 or 44 into its respective shoulder anchor, either 28 or 29. Then, with the baby in the panel 32 and next to the body of the adult, the adult may employ both hands to snap the other of the clips 43 or 44 into its respective anchor 28 or 29. Observe that the baby panel provides a solid, strong, permanently-positioned body of material (sections 34 and 35 of the panel) at lateral sides of the baby. This feature contributes to safety and security. Further, all fasteners and adjustment features are free of the baby and cannot create discomfort. The adult harness is padded throughout the areas bearing or contactable by the baby.

Removing the baby from the carrier is extremely simple, for all that is necessary is that of unclipping one of the clips 43 or 44. That action alone makes it possible to lift the baby from the carrier; and the entire adult harness portion of the carrier remains undisturbed on the adult as the baby is removed from (or even replaced in) the panel 32.

As used herein, the term "baby" is intended to embrace infants or small children of a size normally needing the care of being carried.

The invention may be embodied in other specific forms than that illustrated without departing from the spirit or essential characteristics thereof. The illustrated embodiment is therefore to be considered in all respects as illustrative and not restrictive, the scope of the invention being indicated by the appended claims rather than by the foregoing description; and all changes which come within the meaning and range of equivalency of the claims are therefore intended to be embraced thereby.

That which is claimed is:

1. A baby carrier comprising a harness for attachment to an adult independently of and preliminary to placing a baby in the carrier, and a baby support panel fixed to the harness, said harness comprising a waistband for fastening about the torso of an adult at or above the waist, and two shoulder straps fixed to the waistband at spaced locations for extending upward from the waistband along lateral portions of the upper frontal torso of an adult and over the shoulders and then in crossed relationship at the back of the upper torso of the adult, with the ends of the shoulder straps removably fastened to the waistband at lateral locations of the waistband as worn by an adult, each said shoulder strap having a shoulder level anchor element thereon at a location proximate to the portion thereof passing over the shoulder of an adult, and said baby support panel being characterized by the fact that it is fixed solely to the waistband of the harness of the adult, has leg openings proximate to said waistband, and includes fastening means extending from the lateral edges of the end of the panel most remote from the waistband for removably fastening the panel to the shoulder level anchor elements on the shoulder straps of the adult harness.

2. The baby carrier of claim 1 wherein said leg openings of said baby support panel have an edge formed in part by the waistband.

3. The baby carrier of claim 1 wherein said baby support panel includes gathered elasticized lateral edge sections.

4. The baby carrier of claim 1 wherein said baby support panel includes lateral sections at the outward portion of the leg openings thereof, with said lateral sections fixed to the waistband at locations in substantial alignment with the locations at which the shoulder straps extend upwardly from the waistband.

5. The baby carrier of claim 1 wherein the baby support panel includes a horizontal reinforcing strap along the end of the panel most remote from the waistband, with said fastening means of said panel carried by said strip member.

6. The baby carrier of claim 1 wherein said waistband is padded at least through the length thereof extending between the locations at which the shoulder straps are fixed thereto.

7. The baby carrier of claim 1 wherein the shoulder straps are padded at least in the portion thereof extending upward from the waistband and over the shoulders of an adult.

8. The baby carrier of claim 1 wherein the waistband includes shoulder strap anchor means laterally proximate to the location at which said shoulder straps are fixed to said waistband.

9. A baby carrier comprising a harness for attachment to the upper torso of an adult independently of and preliminary to placing a baby in the carrier, and a baby support panel fixed to the harness, said harness comprising a waistband for fastening about the torso of an adult at or above the waist, two shoulder straps fixed to the waistband at spaced locations for extending substantially directly up from the waistband along lateral portions of the upper frontal torso of an adult and over the shoulders and then in crossed relationship on the back upper torso of the adult, with the ends of the shoulder straps removably fastened to the waistband at lateral locations of the waistband as worn by an adult, and shoulder level anchor means carried upon said shoulder straps at a location placing them proximate to the shoulder area of an adult wearing the harness, and said baby support panel being characterized by the fact that it includes two U-shaped leg openings having a crotch panel section therebetween fixed to the lower edge of the waistband and having laterally outward sections fixed to the lower edge of the waistband at locations aligned with the shoulder straps extending up from the waistband, with the waistband itself forming an edge of the leg openings of U-shape, and characterized further by a reinforcing strap of generally horizontal orientation along the edge of the panel most remote from the waistband, said reinforcing strap having fastening means at each end thereof for removable affixation to said shoulder level anchor means of the shoulder straps of the adult harness.

10. The baby carrier of claim 9 wherein said baby support panel includes gathered elasticized lateral edge sections.

11. The baby carrier of claim 9 wherein said waistband is padded at least through the length thereof extending between the locations at which the shoulder straps are fixed thereto.

12. The baby carrier of claim 9 wherein the shoulder straps are padded at least in the portion thereof extending up from the waistband and over the shoulders of an adult.

13. The baby carrier of claim 9 wherein the waistband includes shoulder strap anchor means laterally proximate to the location at which said shoulder straps are fixed to said waistband.

14. The baby carrier of claim 9 wherein said waistband is padded at least through the length thereof extending between the locations at which the shoulder straps are fixed thereto and said shoulder straps are padded at least in the portion thereof extending up from the waistband and over the shoulders of an adult.

* * * * *